US010712053B2

(12) United States Patent
Morie

(10) Patent No.: US 10,712,053 B2
(45) Date of Patent: Jul. 14, 2020

(54) CRYOCOOLER

(71) Applicant: Sumitomo Heavy Industries, Ltd., Tokyo (JP)

(72) Inventor: Takaaki Morie, Kanagawa (JP)

(73) Assignee: SUMITOMO HEAVY INDUSTRIES, LTD., Tokyo (JP)

( * ) Notice: Subject to any disclaimer, the term of this patent is extended or adjusted under 35 U.S.C. 154(b) by 298 days.

(21) Appl. No.: 15/235,769

(22) Filed: Aug. 12, 2016

(65) Prior Publication Data

US 2017/0051952 A1 Feb. 23, 2017

(30) Foreign Application Priority Data

Aug. 17, 2015 (JP) ..... 2015-160652
Aug. 17, 2015 (JP) ..... 2015-160653

(51) Int. Cl.
*F25B 9/14* (2006.01)

(52) U.S. Cl.
CPC ..... *F25B 9/14* (2013.01)

(58) Field of Classification Search
CPC ..... F25B 9/14; F02G 1/053; F02G 1/0535; F02G 2270/95; F02G 2270/30; F02G 2270/42
USPC ..... 62/6
See application file for complete search history.

(56) References Cited

U.S. PATENT DOCUMENTS 4,446,701 A 5/1984 Suzuki et al.
9,366,459 B2 * 6/2016 Morie ..... F25B 9/14
2014/0318155 A1 * 10/2014 Morie ..... F25B 9/14
62/6

FOREIGN PATENT DOCUMENTS

JP S58-047970 A 3/1983
JP 2014139498 A * 7/2014 ..... F25B 9/14
JP 2014214946 A * 11/2014 ..... F25B 9/14

* cited by examiner

*Primary Examiner* — John F Pettitt, III
(74) *Attorney, Agent, or Firm* — Michael Best & Friedrich LLP

(57) ABSTRACT

A cryocooler includes a displacer, a cylinder in which the displacer is accommodated, a Scotch yoke mechanism which drives the displacer, and a housing in which the Scotch yoke mechanism is accommodated. The Scotch yoke mechanism includes a crank, a yoke plate, a second drive shaft, and a first drive shaft. The housing may include a drive mechanism accommodation chamber in which the crank and the yoke plate are accommodated, a first assist chamber in which a distal end of the first drive shaft is accommodated, and a second assist chamber which is provided between the drive mechanism accommodation chamber and a gas chamber or between the drive mechanism accommodation chamber and the first assist chamber. The first assist chamber and the second assist chamber can be adjusted to a higher pressure than the pressure in the drive mechanism accommodation chamber.

12 Claims, 7 Drawing Sheets

CRYOCOOLER

RELATED APPLICATIONS

Priority is claimed to Japanese Patent Application No. 2015-160652, filed Aug. 17, 2015, the entire content of which is incorporated herein by reference.

Priority is claimed to Japanese Patent Application No. 2015-160653, filed Aug. 17, 2015, the entire content of which is incorporated herein by reference.

BACKGROUND

Technical Field

Certain embodiment of the present invention relate to a cryocooler in which high-pressure refrigerant gas is expanded to generate coldness.

Description of Related Art

In the related art, as an example of a cryocooler which generates cryogenic temperatures, a Gifford-McMahon (GM) cryocooler is known. In the GM cryocooler, a displacer reciprocates in a cylinder, and thus, a volume in an expansion space is changed. The expansion space and a discharge side and a suction side of a compressor are selectively connected to each other according to the change of the volume, and thus, the refrigerant gas is expanded in the expansion space. A cooling object is cooled by the cold refrigerant gas.

SUMMARY

According to an aspect of the present invention, there is provided a cryocooler, including: a displacer which extends in an axial direction; a cylinder in which the displacer is accommodated so as to be reciprocated in the axial direction; a drive mechanism which drives the displacer; and a housing in which the drive mechanism is accommodated. The drive mechanism includes an eccentric rotor, a yoke plate which is reciprocated by rotation of the eccentric rotor, a second shaft portion which extends from the yoke plate in the axial direction and is connected to the displacer, and a first shaft portion which extends from the yoke plate to a side opposite to the second shaft portion. A gas expansion chamber is formed between the cylinder and the displacer on one side in the axial direction, and a gas chamber different from the gas expansion chamber is formed between the cylinder and the displacer on the other side in the axial direction, and the housing includes a first chamber in which the eccentric rotor and the yoke plate are accommodated, a second chamber in which a distal end of the first shaft portion is accommodated and which can be adjusted to a higher pressure than a pressure in the first chamber, and a third chamber which is provided between the first chamber and the gas chamber or between the first chamber and the second chamber, and can be adjusted to a higher pressure than the pressure in the first chamber.

According to an aspect of the present invention, there is provided a cryocooler, including: a displacer which extends in an axial direction; a cylinder in which the displacer is accommodated so as to be reciprocated in the axial direction; a drive mechanism which drives the displacer; and a housing in which the drive mechanism is accommodated. The drive mechanism includes an eccentric rotor, a yoke plate which is reciprocated by rotation of the eccentric rotor, and a shaft portion which extends from the yoke plate in the axial direction. The housing includes a first chamber in which the eccentric rotor and the yoke plate are accommodated, and a second chamber which is adjacent to the first chamber, accommodates a portion of the shaft portion, and can be adjusted to a higher pressure than a pressure in the first chamber. The cryocooler further includes a control unit which acquires information relating to a force in the axial direction applied to the drive mechanism, and adjusts a pressure in the second chamber to alleviate the force.

DETAILED DESCRIPTION

Figure 1:
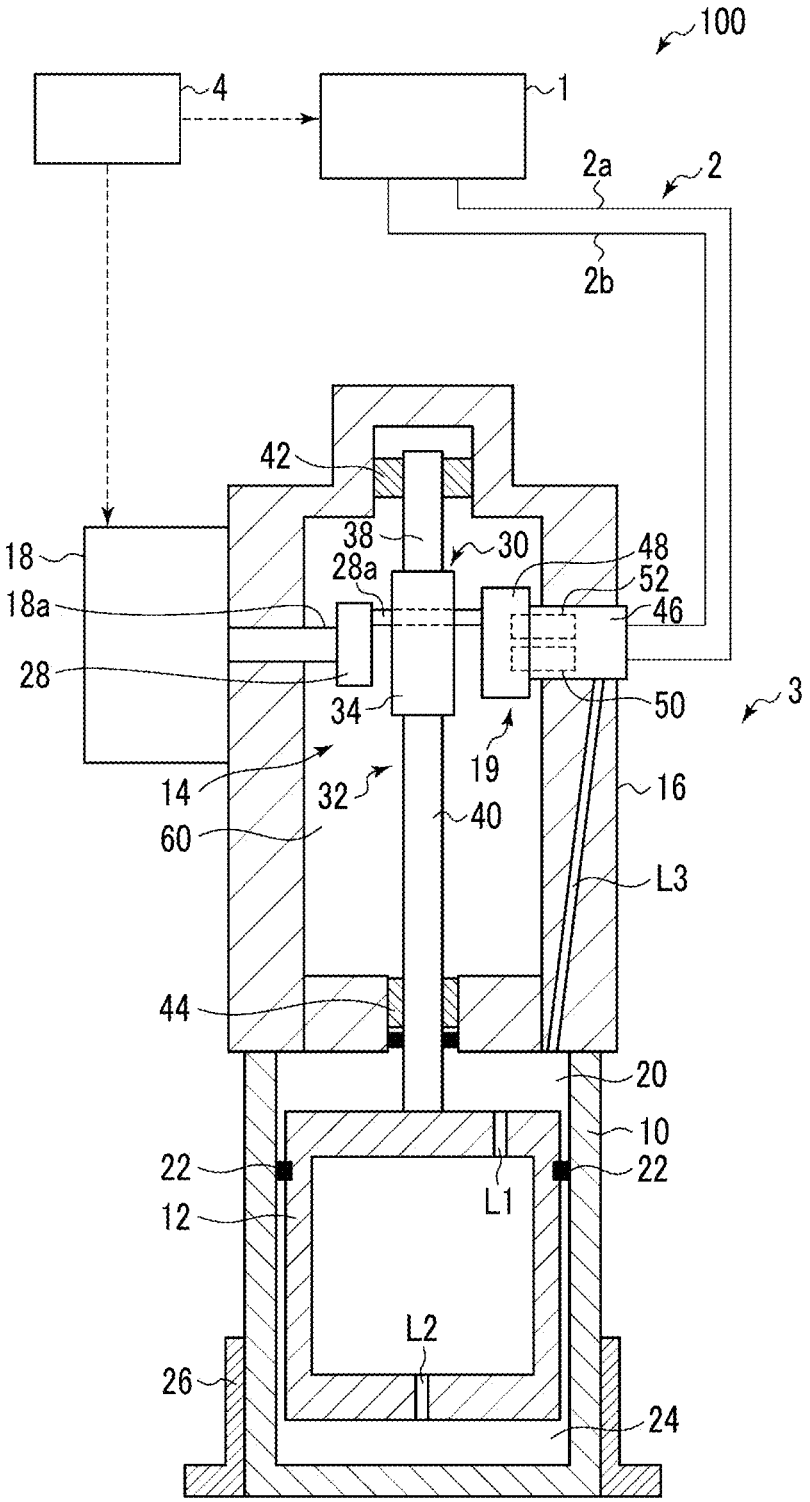
FIG. 1 is a schematic view showing a cryocooler according to first related art.

A force, which is generated due to a pressure loss of the refrigerant gas passing through the inside of the displacer, acts on the displacer. If the size of the displacer increases according to an increase in the size of the GM cryocooler, the force which acts on the displacer and is generated due to the pressure loss increases. In this case, a load which is required so as to drive the displacer increases, and a load which is applied to a drive mechanism which drives the displacer also increases. Accordingly, loads which are applied to components configuring the drive mechanism also increase, and the life-span of the drive mechanism is shortened. If the load applied to the drive mechanism increases, a load of a motor for driving the drive mechanism also increases, and for example, in a case where a synchronous motor is used as the drive motor, synchronization deviation (slip) may occur, and a normal cycle operation of the GM cryocooler may not be easily performed.

It is desirable to provide a cryocooler in which a load applied to the drive mechanism of the displacer can be decreased.

In addition, arbitrary combinations of the above-described components, or components or expression of the present invention may be replaced by each other in methods, devices, systems, or the like, and these replacements are also included in aspects of the present invention.

According to the present invention, it is possible to decrease a load applied to the drive mechanism of the displacer.

Hereinafter, the same reference numerals are assigned to the same or the corresponding components, members, and processes shown in each drawing, and overlapping descriptions thereof are appropriately omitted. Moreover, for easy understanding, dimensions of members in each drawing are appropriately enlarged and decreased. In addition, in descriptions with respect to embodiments in each drawing, members which are not important are shown so as to be partially omitted.

First Related Art

Before a cryocooler according to an embodiment is described, the related arts will be described. FIG. 1 is a schematic view showing a cryocooler 100 according to a first related art. The cryocooler 100 is a Gifford McMahon (GM cryocooler), and includes a compressor 1, a pipe 2, an expander 3, and a control unit 4.

The compressor 1 compresses a low-pressure refrigerant gas which is returned from the expander 3, and supplies a compressed high-pressure refrigerant gas to the expander 3. The pipe 2 includes a high-pressure pipe 2*a* and a low-pressure pipe 2*b*. The high-pressure pipe 2*a* is connected to a discharge side of the compressor 1. A high-pressure refrigerant gas flows through the high-pressure pipe 2*a* from the compressor 1 toward the expander 3. The low-pressure pipe 2*b* is connected to a suction side of the compressor 1. A low-pressure refrigerant gas flows through the low-pressure pipe 2*b* from the expander 3 toward the compressor 1. For example, helium gas can be used as the refrigerant gas. In addition, nitrogen gas or other gas may be used as the refrigerant gas.

The expander 3 expands the high-pressure refrigerant gas supplied from the compressor 1, and thus, generates coldness. The expander 3 includes a cylinder 10, a displacer 12, a Scotch yoke mechanism 14, a housing 16, a motor 18, and a rotary valve 19.

Hereinafter, in order to easily show positional relationships of the components of the expander 3, a term such as an "axial direction" may be used. The axial direction indicates a direction in which a first drive shaft 38 and a second drive shaft 40 (both will be described below) extend. The axial direction is coincident with a direction in which the displacer 12 moves. For convenience, a portion which is relatively close to an expansion space 24 or a cooling stage 26 (both will be described below) in the axial direction may be referred to as an "upper portion", and a portion which is relatively far from the expansion space 24 or the cooling stage 26 may be referred to as a "lower portion". In addition, the above-described expressions are not related to disposition of the expander 3 when the expander 3 is attached.

The cylinder 10 has a bottomed cup shape in which a cylindrical portion and a bottom portion are integrally formed, and the displacer 12 is accommodated in the cylinder 10 so as to be reciprocated in the axial direction. For example, the cylinder 10 is formed of a stainless steel considering strength, a thermal conductivity, or the like.

The displacer 12 reciprocates between a top dead center and a bottom dead center in the cylinder 10. Here, the top dead center indicates the position of the expander space 24 when the volume of the expansion space 24 is the maximum volume, and the bottom dead center indicates the position of the expansion space 24 when the volume of the expansion space 24 is the minimum volume. The displacer 12 includes an outer peripheral surface having a cylindrical shape, and the inside of the displacer 12 is filled with a regenerator material (not shown). For example, from the viewpoint of specific weight, strength, thermal conductivity, or the like, the displacer 12 is formed of a resin such as bakelite (fabric-containing phenol). For example, the regenerator material is configured of a wire mesh or the like.

A gas flow path L1 through which a gas chamber 20 and the inside of the displacer 12 communicate with each other is formed on the upper portion of the displacer 12. Here, the gas chamber 20 is a space which is formed by the cylinder 10 and the upper end of the displacer 12. The volume of the gas chamber 20 is changed by reciprocation of the displacer 12. Since the temperature of the gas chamber 20 is close to a room temperature at which the expander is installed, the gas chamber 20 may be referred to as a room temperature chamber.

A gas flow path L2 through which the inside of the displacer 12 and the expansion space 24 communicate with each other is formed on the lower portion of the displacer 12. Here, the expansion space 24 is a space which is formed by the cylinder 10 and the lower end of the displacer 12. The volume of the expansion space 24 is changed according to the reciprocation of the displacer 12. The cooling stage 26 which is thermally connected to a cooling object (not shown) is disposed at a position on the outer periphery of the cylinder 10 corresponding to the expansion space 24. The cooling stage 26 is cooled by the refrigerant gas inside the expansion space 24.

A seal 22 is provided between the inner peripheral surface of the cylinder 10 and the displacer 12. Accordingly, the flow of the refrigerant gas between the gas chamber 20 and the expansion space 24 is performed via the inside of the displacer 12.

The motor 18 rotates a rotary shaft 18*a* which is connected to the motor 18.

Figure 2:
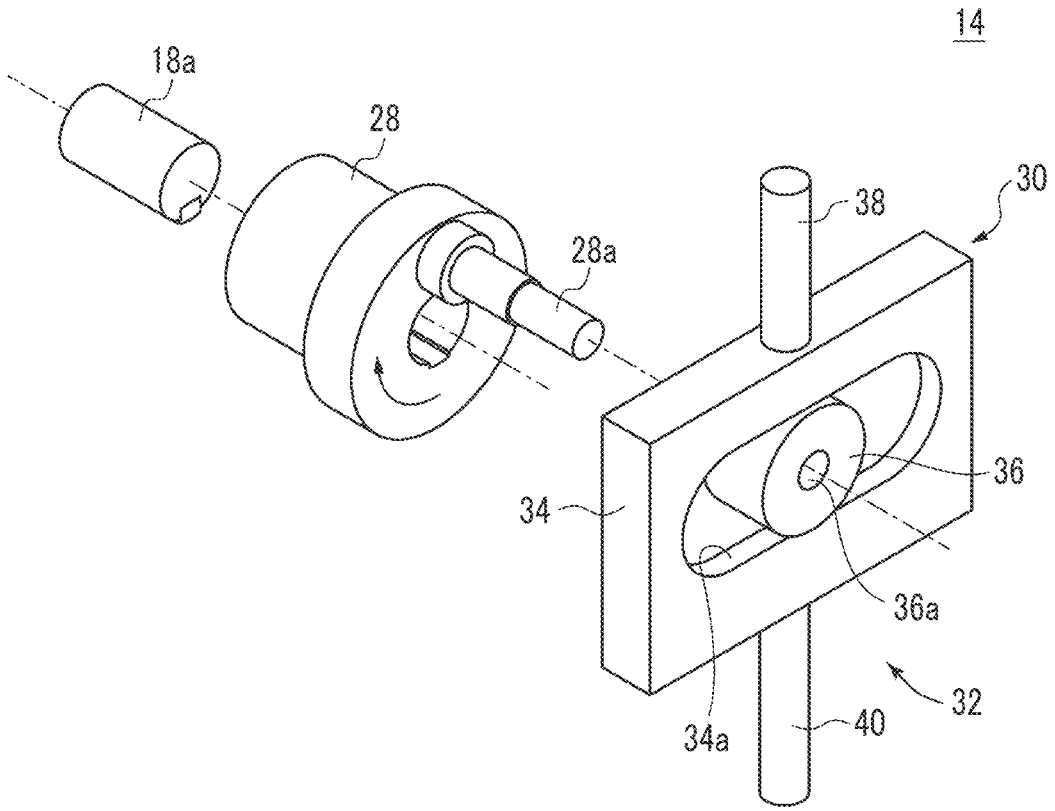
FIG. 2 is an exploded perspective view of a Scotch yoke mechanism.

FIG. 2 is an exploded perspective view of the Scotch yoke mechanism 14. The Scotch yoke mechanism 14 reciprocates the displacer 12. The Scotch yoke mechanism 14 includes a crank 28 and a Scotch yoke 30.

The crank 28 is fixed to the rotary shaft 18*a* of the motor 18. The crank 28 includes a crank pin 28*a* at a position which is eccentric from a position at which the rotary shaft 18*a* is fixed to the crank 28. Accordingly, if the crank 28 is fixed to the rotary shaft 18*a*, the crank pin 28*a* is eccentric to the rotary shaft 18*a*.

The Scotch yoke 30 includes a drive shaft 32, a yoke plate 34, and a roller bearing 36. The drive shaft 32 includes a first drive shaft 38 and a second drive shaft 40. The first drive shaft 38 extends upward from the upper center portion of the yoke plate 34. The second drive shaft 40 extends downward from the lower center portion of the yoke plate 34.

The first drive shaft 38 is supported by a first sliding bearing 42 so as to be movable in the axial direction. The second drive shaft 40 is supported by a second sliding bearing 44 so as to be movable in the axial direction. Accordingly, the drive shaft 32 and the Scotch yoke 30 are configured so as to be movable in the axial direction.

The yoke plate 34 is a plate-shaped member, and a horizontally long window 34*a* at the center of the yoke plate 34. The horizontally long window 34*a* extends in a direction which intersects, for example, is orthogonal to the direction (that is, axial direction) in which the first drive shaft 38 and the second drive shaft 40 extend.

The roller bearing 36 is disposed in the horizontally long window 34*a* so as to be rollable. An engagement hole 36*a* which engages with the crank pin 28*a* is formed at the center of the roller bearing 36, and the crank pin 28*a* penetrates the engagement hole 36*a*.

If the motor 18 is driven and rotates the rotary shaft 18*a*, the crank pin 28*a* and the roller bearing 36 engaging with the crank pin 28*a* rotate so as to draw a circle. The roller bearing 36 rotates so as to draw a circle, and thus, the Scotch yoke 30 reciprocates in the axial direction. In this case, the roller bearing 36 reciprocates in the horizontally long window 34*a* in a direction intersecting the axial direction.

The second drive shaft 40 is connected to the displacer 12. Accordingly, the Scotch yoke 30 moves in the axial direction, and thus, the displacer 12 reciprocates in the cylinder 10 in the axial direction.

Returning to FIG. 1, the housing 16 includes a drive mechanism accommodation chamber 60. The Scotch yoke mechanism 14 is accommodated in the drive mechanism accommodation chamber 60. The drive mechanism accommodation chamber 60 communicates with the suction side of the compressor 1 via the low-pressure pipe 2*b*. Accordingly, the pressure of the drive mechanism accommodation chamber 60 is maintained so as to be a low pressure which is approximately the same as the pressure of the suction side of the compressor 1. In the housing 16, a gas flow path L3 having one end communicating with the gas chamber 20 and the other end communicating with the rotary valve 19 is formed.

The rotary valve 19 is provided in a flow path of the refrigerant gas from the compressor 1 to the gas chamber 20. The rotary valve 19 includes a stator valve 46 and a rotor valve 48. The rotor valve 48 is rotatably supported in the housing 16. The stator valve 46 is fixed to the housing 16 so as not to be rotated. The distal end of the crank pin 28*a* of the Scotch yoke mechanism 14 is connected to the rotor valve 48. Accordingly, if the crank pin 28*a* rotates according to rotation of the rotary shaft 18*a* of the motor 18, the rotor valve 48 rotates with respect to the stator valve 46. In this way, the rotor valve 48 rotates synchronously with the Scotch yoke mechanism 14.

The stator valve 46 and the rotor valve 48 configure a supply valve 50 through which a high-pressure working gas discharged from the compressor 1 is introduced into the expansion space 24 via the gas chamber 20, and an exhaust valve 52 through which a working gas introduced from the expansion space 24 into the compressor 1 via the gas chamber 20. The supply valve 50 and the exhaust valve 52 are open and closed according to the rotation of the rotor valve 48.

If the supply valve 50 is opened according to the rotation of the rotor valve 48, the high-pressure working gas from the compressor 1 is supplied to the gas chamber 20 through the gas flow path L3. Meanwhile, if the exhaust valve 52 is opened according to the rotation of the rotor valve 48, the working gas having a low pressure is recovered to the compressor 1 from the gas chamber 20 via the gas flow path L3.

Figure 3:
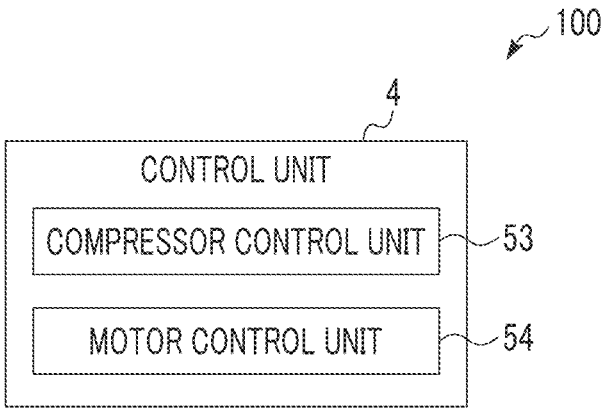
FIG. 3 is a block diagram showing a functional configuration of a control unit of FIG. 1.

FIG. 3 is a block diagram showing a functional configuration of the control unit 4 of FIG. 1. Each block shown in FIG. 3 can be realized by an element or a mechanical device including a Central Processing Unit (CPU) of a computer in a hardware manner, and can be realized by a computer program or the like in a software manner. Here, each block indicates a functional block which is realized by cooperation thereof. Accordingly, a person skilled in the art understands that the functional blocks may be performed in various manners by combination of software and hardware. This is similarly applied to FIG. 7.

The control unit 4 includes a compressor control unit 53 and a motor control unit 54. The compressor control unit 53 controls the operation of the compressor 1. For example, the compressor control unit 53 controls the compressor 1 such that a pressure difference between a high pressure and a low pressure of the compressor 1 becomes a target pressure. The motor control unit 54 controls driving of the motor 18. For example, the motor control unit 54 rotates the rotary shaft 18*a* of the motor 18 at a desired rotating speed.

The operation of the cryocooler 100 having the above-described configuration will be described. The displacer 12 moves from the bottom dead center toward the top dead center, and thus, the supply valve 50 is opened. In this case, a high-pressure refrigerant gas flows from the compressor 1 into the gas chamber 20 via the high-pressure pipe 2*a* and the supply valve 50. The high-pressure refrigerant gas flows from the gas flow path L1 into the inside of the displacer 12, and is cooled by a regenerator material. The cooled refrigerant gas flows from the gas flow path L2 into the expansion space 24. Accordingly, the inside of the expansion space 24 becomes a high-pressure state.

The supply valve 50 is closed before the displacer 12 reaches the top dead center. Thereafter, if the exhaust valve 52 is opened immediately before the displacer 12 reaches the top dead center, the state of the refrigerant gas inside the expansion space 24 is changed from a high pressure state to a low pressure state, and thus, the refrigerant gas is expanded. As a result, the temperature of the refrigerant gas inside the expansion space 24 further decreases. In addition, the cooling stage 26 is cooled by the refrigerant gas having a decreased temperature.

If the displacer 12 reaches the top dead center, continuously, the movement of the displacer 12 from the top dead center toward the bottom dead center starts. According to this, a low-pressure refrigerant gas cools the regenerator material according to a route which is reverse to the above-described route, and is returned to the compressor 1 via the exhaust valve 52 and the low-pressure pipe 2*b*. In addition, the exhaust valve 52 is closed before the displacer 12 reaches the bottom dead center. Thereafter, if the supply valve 50 is opened immediately before the displacer 12 reaches the bottom dead center, a high-pressure refrigerant gas flows from the compressor 1 into the gas chamber 20 via the high-pressure pipe 2*a* and the supply valve 50 again. If the displacer 12 reaches the bottom dead center, continuously, the movement of the displacer 12 from the bottom dead center toward the top dead center starts.

The above-described operations are set to one cycle, and by repeating the refrigeration cycle, the cooling object which is thermally connected to the cooling stage 26 is cooled.

Figure 4:
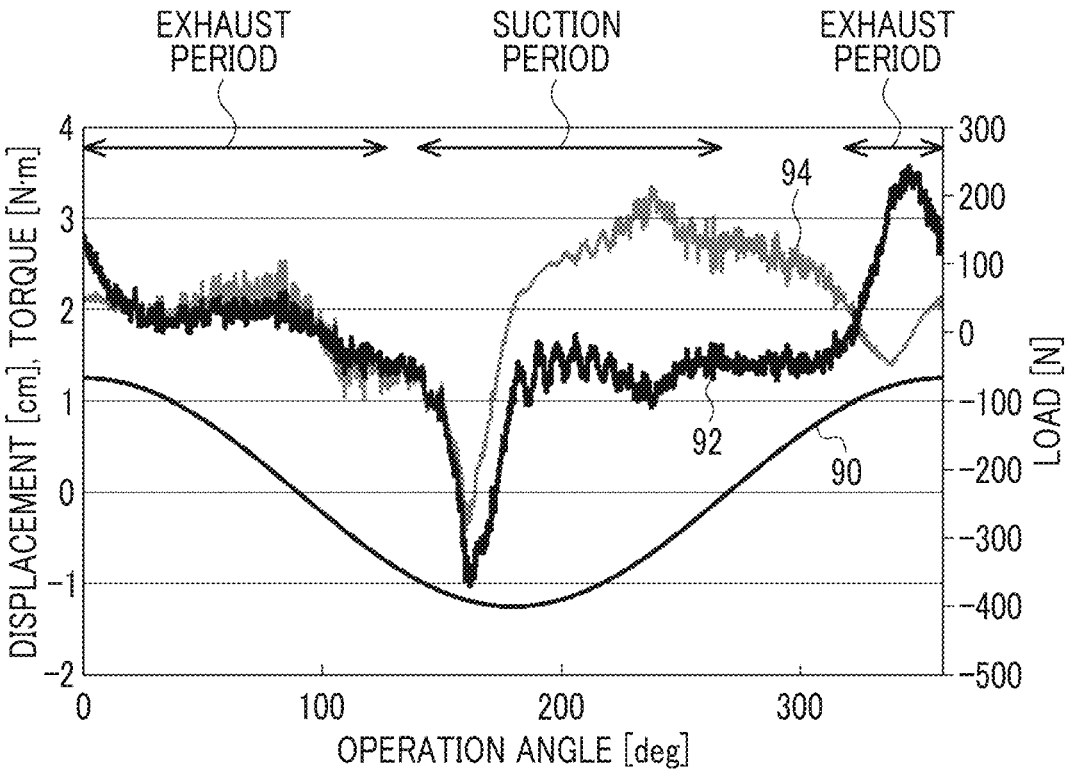
FIG. 4 shows a load and torque applied to a motor of the cryocooler according to the first related art.

FIG. 4 shows a load in the axial direction applied to the motor 18 and load torque applied to the motor 18 in the cryocooler 100 according to the first related art. In FIG. 4, a horizontal axis indicates an operation angle (angle of crank 28) [deg]. 0° (360°) is an angle when the displace 12 is positioned at the top dead center, that is, when the volume of the expansion space 24 is the maximum volume, and 180° is an angle when the displacer 12 is positioned at the bottom dead center, that is, when the volume of the expansion space 24 is the minimum volume. In addition, in FIG. 4, a left vertical axis indicates displacement [cm] of the displacer 12 and load torque [N·m] applied to the motor 18. Aright vertical axis indicates a load [N] in the axial direction applied to the motor 18. Here, an upward load is positive. A graph 90 indicates the displacement of the displacer 12, a graph 92 indicates the loads in the axial direction applied to the Scotch yoke mechanism 14 and the motor 18, and a graph 94 indicates the load torque applied to the motor 18. In addition, in the graph 94, the load torque required for rotating the rotor valve 48 is constant.

As described above, the regenerator material fills the inside of the displacer 12 to increase cooling efficiency. Accordingly, a pressure loss is generated when the refrigerant gas is discharged from the inside of the displacer 12, and thus, a force due to the pressure loss acts on the displacer 12.

Here, a period when the exhaust valve 52 is in an open state is referred to as an exhaust period. In a period (for example, 0° to 120°) in which the operation angle is included in a range of 0° to 180° in the exhaust period, the movement direction (downward) of the displacer 12 is opposite to the flow direction of the refrigerant gas. Accordingly, the force due to the pressure loss acts on the displacer 12 in a direction opposite to the movement direction of the displacer 12. This force is transmitted to the Scotch yoke mechanism. 14 via the second drive shaft 40, and becomes a load which prevents the rotation of the motor 18 which drives the Scotch yoke mechanism 14.

Here, a period when the supply valve 50 is in an open state is referred to as a suction period. In a period (for example, 120° to 180°) in which the operation angle is included in a range of 0° to 180° in the suction period, the movement direction (downward) of the displacer 12 is the same as the flow direction of the refrigerant gas. Accordingly, the force due to the pressure loss acts on the displacer 12 in a direction which is the same as the movement direction of the displacer 12. This force is transmitted to the Scotch yoke mechanism 14 via the second drive shaft 40, and becomes a load which assists the rotation of the motor 18 which drives the Scotch yoke mechanism 14.

In a period (for example, 180° to 260°) in which the operation angle is included in a range of 180° to 360° in the suction period, the movement direction (upward) of the displacer 12 is opposite to the flow direction of the refrigerant gas. Accordingly, the force due to the pressure loss acts on the displacer 12 in the direction which is opposite to the movement direction of the displacer 12. This force becomes a load which prevents the rotation of the motor 18.

In a period (for example, 320° to 360°) in which the operation angle is included in a range of 180° to 360° in the exhaust period, the movement direction (upward) of the displacer 12 is the same as the flow direction of the refrigerant gas. Accordingly, the force due to the pressure loss acts on the displacer 12 in the direction which is the same as the movement direction of the displacer 12. This force becomes a load which assists the rotation of the motor 18.

In this way, the load due to the pressure loss is applied to the Scotch yoke mechanism 14 and the motor 18. If a great load is applied to the Scotch yoke mechanism 14, the life-span of the component is shortened. In addition, regardless of the load being the load which prevents the rotation of the motor 18 or being the load which assists the rotation, if a load greater than an allowable value is applied to the motor 18, synchronization deviation (slip) of the motor 18 occurs, and there is a concern that a normal cycle operation of the cryocooler 100 may not be performed.

In addition, if cooling capacity of the cryocooler 100 increases, since the amount of gas passing through the inside of the displacer 12 also increases, the pressure loss generated when the refrigerant gas is discharged from the inside of the displacer 12 also increases. Accordingly, if the cooling capacity of the cryocooler 100 increases, the load applied to the Scotch yoke mechanism 14 and the motor 18 also increases. Therefore, this problem becomes more serious as the size of the cryocooler 100 increases.

(Second Related Art)

Figure 5:
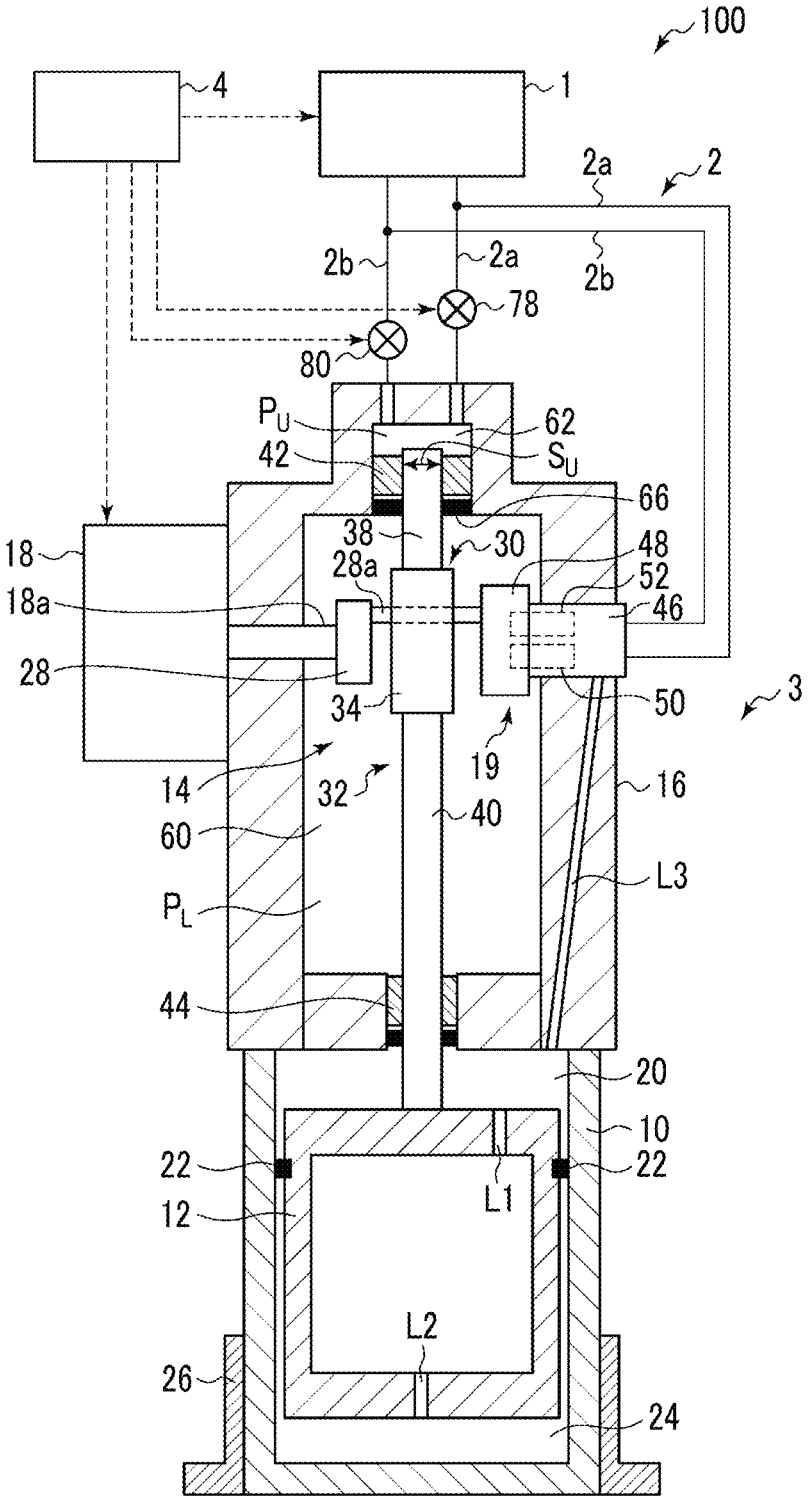
FIG. 5 is a schematic view showing a cryocooler according to second related art.

Continuously, a second related art in which the first related art is improved will be described. FIG. 5 is a schematic view showing a cryocooler 100 according to the second related art. A difference between FIG. 1 and FIG. 5 is mainly described.

The housing 16 includes the drive mechanism accommodation chamber 60 and a first assist chamber 62. The upper end section of the first drive shaft 38 is accommodated in the first assist chamber 62. A seal 66 is provided on the lower portion of the first assist chamber 62. The seal 66 airtightly separates the first assist chamber 62 from the drive mechanism accommodation chamber 60 while allowing the movement of the first drive shaft 38 in the axial direction. For example, a slipper seal or a clearance seal can be used as the seal 66. In addition, the first sliding bearing 42 and the seal 66 may be integrated with each other.

The high-pressure pipe 2*a* and the low-pressure pipe 2*b* are connected to the first assist chamber 62. A first valve 78 is provided on the high-pressure pipe 2*a* between the first assist chamber 62 and the compressor 1. If the first valve 78 is opened, the refrigerant gas in the first assist chamber 62 becomes a high-pressure state. A second valve 80 is provided on the low-pressure pipe 2*b* between the first assist chamber 62 and the compressor 1. If the second valve 80 is opened, the refrigerant gas of the first assist chamber 62 becomes a low-pressure state. As described above, since the first assist chamber 62 is airtightly separated from the drive mechanism accommodation chamber 60, a force $F_1$ in the axial direction represented by the following Expression acts on the first drive shaft 38 by a pressure difference between the first assist chamber 62 and the drive mechanism accommodation chamber 60. Here, the downward direction is positive.

$$F_1 = S_U \times (P_U - P_L) \tag{1}$$

Here, $S_U$ indicates an area (hereinafter, simply referred to as a "cross-sectional area") of a cross section orthogonal to the axial direction of the first drive shaft 38, $P_U$ indicates the pressure of the first assist chamber 62, and $P_L$ indicates the pressure of the drive mechanism accommodation chamber 60.

As described above, since the drive mechanism accommodation chamber 60 is maintained so as to be a low pressure, if the refrigerant gas of the first assist chamber 62 becomes a high-pressure state, a downward force in the axial direction acts on the first drive shaft 38 by the pressure difference between the first assist chamber 62 and the drive mechanism accommodation chamber 60. Since the first drive shaft 38 is connected to the displacer 12 via the Scotch yoke mechanism 14, the displacer 12 is biased downward in the axial direction by the force. That is, the pressure of the working gas supplied to the first assist chamber 62 may operate as an assist force which assists the displacer 12 when the displacer 12 moves downward by the Scotch yoke mechanism 14. By adding the assist force at appropriate timing, it is possible to decrease the loads which are applied to the Scotch yoke mechanism 14 and the motor 18.

However, in the cryocooler 100 according to the second related art, even when the refrigerant gas of the first assist chamber 62 becomes a low-pressure state, the pressure difference between the first assist chamber 62 and the drive mechanism accommodation chamber 60 is not generated, and it is not possible to bias the displacer 12 upward in the axial direction by the pressure difference between the first assist chamber 62 and the drive mechanism accommodation chamber 60. Accordingly, in the period when the operation angle is included in the range of 0° to 180° in the suction period of FIG. 4, it is not possible to decrease the loads which are applied to the motor 18 and the Scotch yoke mechanism 14. In addition, in general, in the second related art, the assist force is applied at a predetermined timing on design. Accordingly, even when the pressure loss, and the magnitudes and the timing of the load applied to the motor 18 due to a behavior, an operation state (whether or not the state is a transient operation state or a regular operation state), a machine difference, or the like of the cryocooler 100 are different from the design values, it is not possible to cope with the difference, and in a case where the assist force is excessively strong, adverse effects may occur.

Embodiment

An outline of a cryocooler according to an embodiment will be described. The cryocooler according to the embodiment includes the second assist chamber in addition to the first assist chamber. The second assist chamber is configured such that an upward assist force in the axial direction acts on the Scotch yoke mechanism. Accordingly, even in the suction period in addition to the exhaust period, it is possible to decrease the loads applied to the motor 18 and the Scotch yoke mechanism 14.

In addition, in the cryocooler according to the embodiment, the load which is applied to the Scotch yoke mechanism and the motor 18 is obtained, and each assist force acts on the Scotch yoke mechanism 14 such the load is alleviated. Accordingly, it is possible to cause the assist force to act on the Scotch yoke mechanism 14 in an appropriate direction at an appropriate timing.

In addition, torque applied to the motor is measured, and it is considered that each assist force acts on the Scotch yoke mechanism so as to decrease the torque. However, even when each assist force acts on the Scotch yoke mechanism such that the torque applied to the motor decreases, there is timing at which the load in the axial direction applied to the Scotch yoke mechanism does not decrease. For example, in the timing at which the operation angle is 0° or 180°, torque is not generated even when the load in the axial direction is applied to the Scotch yoke mechanism. That is, even when the torque is measured at this timing, it is not possible to decrease the load in the axial direction applied to the Scotch yoke mechanism. In this case, adverse effects may be applied to a life-span of a component of the Scotch yoke mechanism. Meanwhile, if a load is applied to the Scotch yoke mechanism decreases, the load in the axial direction applied to the Scotch yoke mechanism and the load torque applied to the motor also decrease. Accordingly, in the present embodiment, the load according to the Scotch yoke mechanism 14 is obtained. Hereinafter, the cryocooler according to the embodiment will be specifically described.

Figure 6:
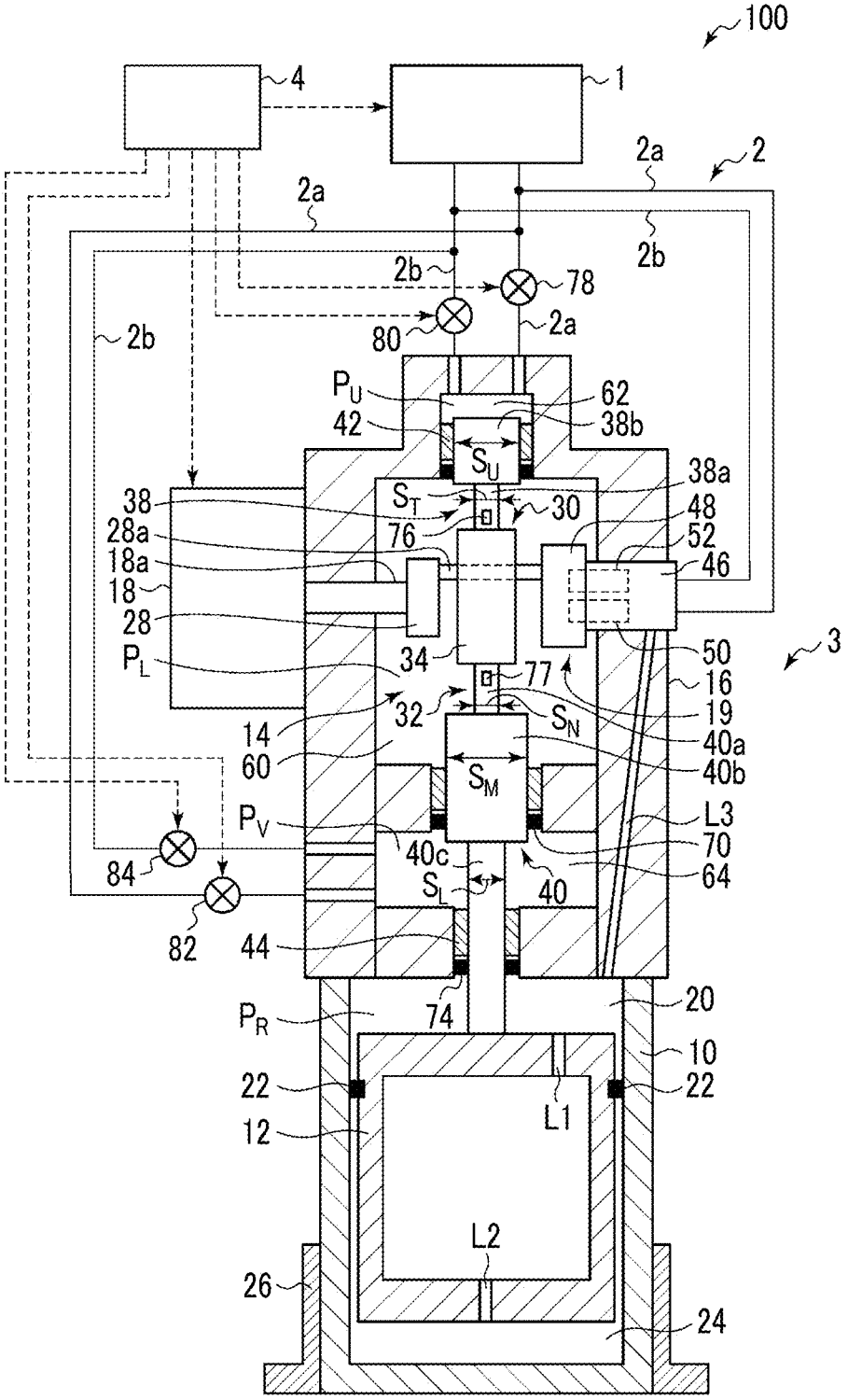
FIG. 6 is a schematic view showing a cryocooler according to an embodiment.

FIG. 6 is a schematic view showing the cryocooler 100 according to the embodiment. Differences between FIG. 6 and FIGS. 1 and 5 are mainly described.

The first drive shaft 38 includes a first small-diameter portion 38*a*, and a first large-diameter portion 38*b* which has a larger cross-sectional area than that of the first small-diameter portion 38*a*. In the present embodiment, the first small-diameter portion 38*a* and the first large-diameter portion 38*b* have columnar shapes.

The second drive shaft 40 includes a second small-diameter portion 40*a*, a second large-diameter portion 40*b* which has a larger cross-sectional area than that of the second small-diameter portion 40*a*, and a second intermediate portion 40*c* which has a cross-sectional area which is larger than that of the second small-diameter portion 40*a* and is smaller than that of the second large-diameter portion 40*b*. In addition, the size relationship between the cross-sectional areas of the second small-diameter portion 40*a* and the second intermediate portion 40*c* may be reverse.

Two strain sensors 76 are bonded to the first small-diameter portion 38*a* of the first drive shaft 38 so as to face each other in a state where the shaft is interposed therebetween. The strain sensors 76 are attached to the portion of the first drive shaft 38 positioned at the drive mechanism accommodation chamber 60. Similarly, two strain sensors 77 are bonded to the second small-diameter portion 40*a* of the second drive shaft 40 so as to face each other in a state where the shaft is interposed therebetween. The strain sensor 77 is attached to the portion of the second drive shaft 40 positioned in the drive mechanism accommodation chamber 60. In addition, preferably, the strain sensors 76 and 77 are provided in the vicinity of the roller bearing 36.

The housing 16 includes the drive mechanism accommodation chamber 60, the first assist chamber 62, and a second assist chamber 64. The first assist chamber 62, the drive mechanism accommodation chamber 60, and the second assist chamber 64 are arranged in this order from the above.

The first assist chamber 62, the first valve 78, and the second valve 80 are configured so as to be similar to the first assist chamber 62, the first valve 78, and the second valve 80 of the second related art. Accordingly, the force in the axial direction represented by the Expression (1) acts on the first drive shaft 38 as an assist force.

The second assist chamber 64 accommodates the lower end section of the second large-diameter portion 40*b*, and the upper portion of the second intermediate portion 40*c*. In other words, the second assist chamber accommodates the connection portion between the second large-diameter portion 40*b* and the second intermediate portion 40*c*. A seal 70 is provided on the upper portion of the second assist chamber 64. The seal 70 admits the movement of the second large-diameter portion 40*b* in the axial direction, and airtightly separates the second assist chamber 64 from the drive mechanism accommodation chamber 60. A seal 74 is provided on the lower portion of the second assist chamber 64. The seal 74 admits the movement of the second intermediate portion 40*c* in the axial direction, and airtightly separates the second assist chamber 64 from the gas chamber 20. Similarly to the seal 66, for example, a slipper seal or a clearance seal may be used as the seals 70 and the seal 74.

The high-pressure pipe 2*a* and the low-pressure pipe 2*b* are connected to the second assist chamber 64. A third valve 82 is provided on the high-pressure pipe 2*a* between the second assist chamber 64 and the compressor 1, and a fourth valve 84 is provided on the low-pressure pipe 2*b* between the second assist chamber 64 and the compressor 1. If the third valve 82 is opened, the refrigerant gas in the second assist chamber 64 becomes a high-pressure state. If the fourth valve 84 is opened, the refrigerant gas in the second assist chamber 64 becomes a low-pressure state. As described above, since the second assist chamber 64 is airtightly separated from the drive mechanism accommodation chamber 60 and the gas chamber 20, a force $F_2$ in the axial direction represented by the following Expression acts on the second drive shaft 40 by the pressure difference between the second assist chamber 64 and the drive mechanism accommodation chamber 60 and the gas chamber 20.

$$F_2=S_M\times(P_L-P_V)+S_L\times(P_V-P_R) \quad (2)$$

Here, $S_M$ indicates the cross-sectional area of the second large-diameter portion 40*b* of the second drive shaft 40, $P_V$ indicates the pressure of the second assist chamber 64, $S_L$ indicates the cross-sectional area of the second intermediate portion 40*c* of the second drive shaft 40, and $P_R$ indicates the pressure of the gas chamber 20.

Since the low-pressure state of the drive mechanism accommodation chamber 60 is maintained as described above and paragraph 2 of the Expression (2) can be ignored if $S_M$ is sufficiently greater than $S_L$, if the refrigerant gas of the second assist chamber 64 becomes a high-pressure state, an upward force in the axial direction acts on the second drive shaft 40 by the pressure difference between the second assist chamber 64 and the drive mechanism accommodation chamber 60. Since the second drive shaft 40 is connected to the displacer 12 via the Scotch yoke mechanism 14, the displacer 12 is biased upward in the axial direction by the force. That is, when the displacer 12 is moved upward by the Scotch yoke mechanism 14, the pressure of the working gas supplied to the second assist chamber 64 acts as an assist force which assists the upward movement of the displacer 12.

Figure 7:
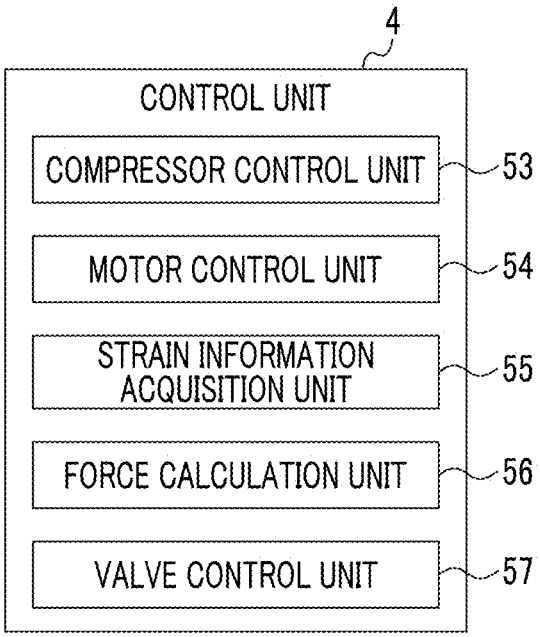
FIG. 7 is a block diagram showing a functional configuration of a control unit of FIG. 6.

FIG. 7 is a block diagram showing a function configuration of the control unit 4 of FIG. 6. Differences between FIG. 3 and FIG. 7 are mainly described. The control unit 4 includes the compressor control unit 53, the motor control unit 54, a strain information acquisition unit 55, a force calculation unit 56, and a valve control unit 57.

The strain information acquisition unit 55 acquires the measurement values of the strain amounts of the first small-diameter portion 38*a* and the second small-diameter portion 40*a* from the strain sensors 76 and 77.

The force calculation unit 56 calculates a force $F_3$ in the axial direction applied to the Scotch yoke mechanism 14. In the present embodiment, the force $F_3$ is calculated from the strain amount obtained by the strain information acquisition unit 55. Here, the downward direction is positive.

$$F_3=X_1\times S_T\times E-X_2\times S_N\times E \tag{3}$$

Here, $X_1$ indicates the strain amount of the first small-diameter portion 38*a*, $S_T$ indicates the cross-sectional area of the first small-diameter portion 38*a*, $X_2$ is the strain amount of the second small-diameter portion 40*a*, $S_N$ indicates the cross-sectional area of the second small-diameter portion 40*a*, and E indicates a young's modulus of the drive shaft.

The valve control unit 57 controls the opening and closing of the first to fourth valves 78 to 84. The pressure in the first assist chamber 62 is a high pressure in the state where the first valve 78 is open and the second valve 80 is closed, and the downward assist force in the axial direction represented by the Expression (1) acts on the Scotch yoke mechanism 14. Meanwhile, the pressure in the second assist chamber 64 is a high pressure in the state where the third valve 82 is opened and the fourth valve 84 is closed, and the upward assist force in the axial direction represented by the Expression (2) acts on the Scotch yoke mechanism 14.

Accordingly, in a case where the force calculated by the Expression (3) is "negative", the valve control unit 57 opens the first valve 78 and closes the second valve 80 so as to cause the pressure of the first assist chamber 62 so as to be a high pressure and opens the fourth valve 84 and closes the third valve 82 so as to cause the second assist chamber 64 to be a low pressure, and the downward assist force acts on the Scotch yoke mechanism 14.

Meanwhile, in a case where the force calculated by the Expression (3) is "positive", the valve control unit 57 opens the second valve 80 and closes the first valve 78 so as to cause the pressure of the first assist chamber 62 to be a low pressure and opens the third valve 82 and closes the fourth valve 84 so as to cause the second assist chamber 64 to be a high pressure, and the upward assist force acts on the Scotch yoke mechanism 14.

That is, the valve control unit 57 controls the opening and closing of the first to fourth valves 78 to 84 such that the loads applied to the Scotch yoke mechanism 14 and the motor 18 are alleviated, that is, approach zero, and thus, an assist force acts on the Scotch yoke mechanism 14.

According to the cryocooler 100 of the above-described embodiment, it is possible to cause an upward assist force in the axial direction in addition to a downward assist force in the axial direction to act on the Scotch yoke mechanism 14 at arbitrary timing. Accordingly, it is possible to decrease the load applied to the Scotch yoke mechanism 14 at any timing of the operation cycle. Therefore, the loads applied to the components of the Scotch yoke mechanism 14 decreases, and it is possible to lengthen the life-spans of the components. In addition, since the load torque applied to the motor 18 which drives the Scotch yoke mechanism 14 decrease, it is possible to prevent occurrence of synchronization deviation.

Moreover, according to the cryocooler 100 of the embodiment, it is possible to cause the assist force to act on the Scotch yoke mechanism 14 such that the load applied to the Scotch yoke mechanism 14 is alleviated by monitoring the force applied to the Scotch yoke mechanism 14. Accordingly, it is possible to apply an assist force having an appropriate magnitude at appropriate timing regardless of a behavior, an operation state (whether or not the state is a transient operation state or a regular operation state), a machine difference, or the like of the cryocooler 100.

In addition, according to the cryocooler 100 of the present embodiment, the strain sensors 76 and 77 are attached to the vicinity of the upper ends of the first drive shaft 38 and the second drive shaft 40 close to the crank pin 28*a* positioned in the drive mechanism accommodation chamber 60. Accordingly, it is possible to obtain approximately all information with respect to the loads following the driving such as a force generated due to a pressure loss, a load due to the own weight of the displacer 12, a drive inertia force, a friction load of a seal, or the like by the strain sensors 76 and 77. That is, it is possible to relatively correctly calculate the load applied to the Scotch yoke mechanism 14.

In addition, according to the cryocooler 100 of the present embodiment, the strain sensors 76 and 77 are bonded to the first small-diameter portion 38*a* of the first drive shaft 38 or the second small-diameter portion 40*a* of the second drive shaft 40. In other words, the strain sensors 76 and 77 are bonded to a narrowed portion having a smaller cross-sectional area than those of other portions. Since strain easily occurs in the narrowed portion, compared to a case where the strain sensors 76 and 77 are bonded to the other portions, it is possible to more correctly acquire the strain amount, and it is possible to correctly calculate the force in the axial direction applied to the Scotch yoke mechanism 14.

Hereinbefore, the cryocooler according to the embodiment is described. The embodiment is exemplified, and a person skilled in the art understands that various modification examples are applied to combinations of components or processing processes and the modification examples are included in the scope of the present invention. Hereinafter, a modification example will be described.

Modification Example 1

In the embodiment, the case is described in which the pressure of the first assist chamber 62 is a high pressure and the pressure of the second assist chamber 64 is a low pressure so as to apply the downward assist force in the axial direction, and the pressure of the first assist chamber 62 is a low pressure and the pressure of the second assist chamber 64 is a high pressure so as to apply the upward assist force in the axial direction. However, the present invention is not limited to this. One of the first assist chamber 62 and the second assist chamber 64 is fixed to a pressure between a high pressure and a low pressure, and the other of the first assist chamber 62 and the second assist chamber 64 is switched to a high pressure and a lower pressure. For example, the pressure of the first assist chamber 62 may be fixed to an intermediate pressure between a low pressure and a high pressure. In this case, the pressure of the first assist chamber 62 may be fixed to the intermediate pressure by opening each of the first valve 78 and the second valve 80 by ½ opening degrees. According to this modification example, since the pressure of one assist chamber is switched to a low pressure and a high pressure, the control is relatively easily performed.

Figure 8:
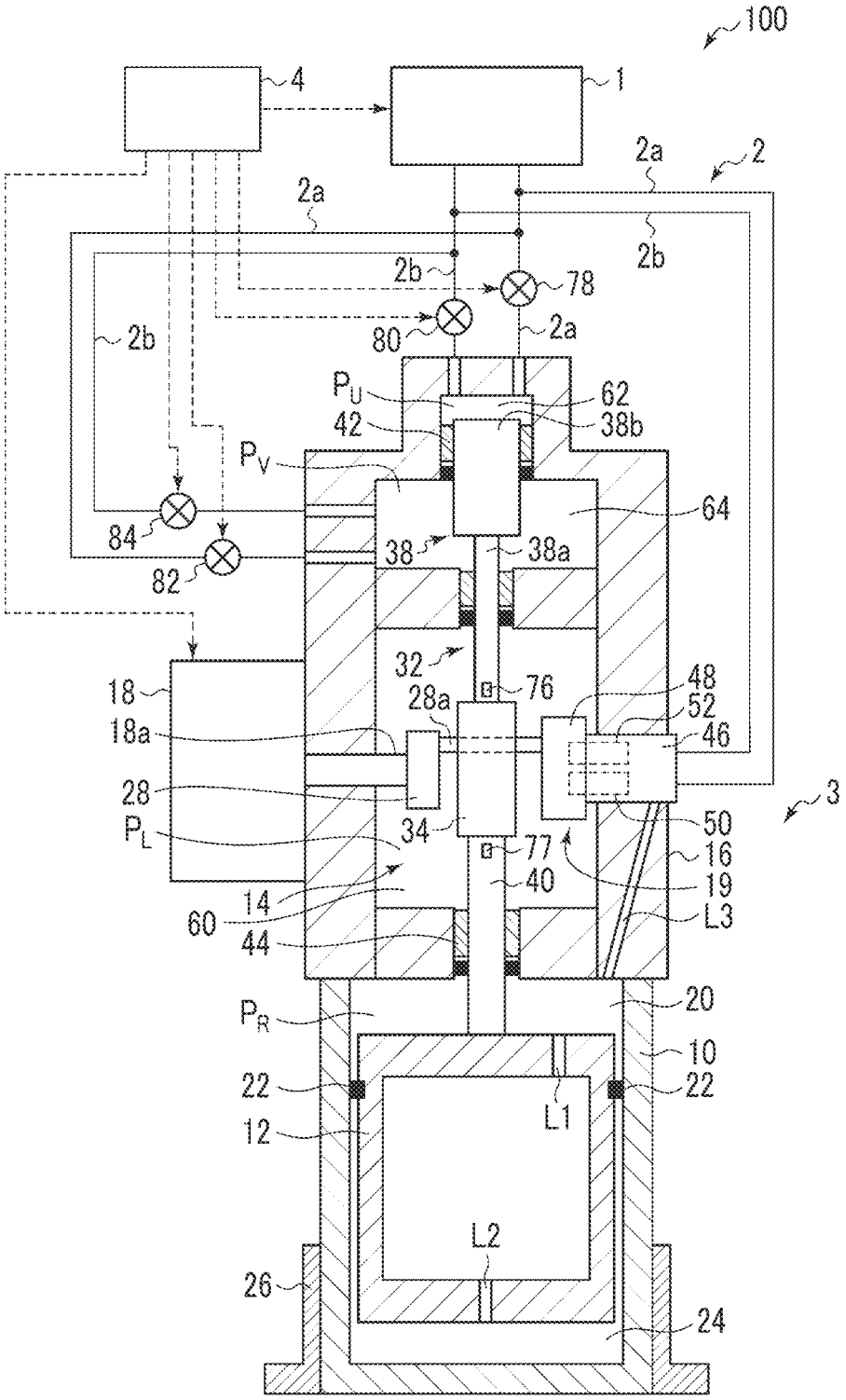
FIG. 8 is a schematic view showing a cryocooler according to a modification example of the embodiment.

In the embodiment, the case is described in which the first assist chamber 62, the drive mechanism accommodation chamber 60, and the second assist chamber 64 are arranged in this order. However, the present invention is not limited to this. FIG. 8 shows a cryocooler 100 according to a modification example of the embodiment. In the present modification, the second assist chamber 64 is provided between the first assist chamber 62 and the drive mechanism accommodation chamber 60. According to the present modification example, it is possible to exert the same effects as those of the cryocooler 100 according to the embodiment.

Modification Example 2

In the embodiment, the case where the number of stages in the expander 3 of the cryocooler 100 is one. However, the present invention is not limited to this, and the number of stages of the expander 3 may be two or more.

Modification Example 3

In the embodiment, the case is described in which the load applied to the Scotch yoke mechanism 14 is calculated based on the measurement values from the strain sensors bonded to both of the first drive shaft 38 and the second drive shaft 40. However, the present invention is not limited to this. According to use environment of the cryocooler 100 and a use method of the cryocooler 100, the load applied to the Scotch yoke mechanism 14 may be calculated by the strain amount of one of the first drive shaft 38 and the second drive shaft 40. In this case, a strain sensor may be bonded to only one of the first drive shaft 38 or the second drive shaft 40.

Modification Example 4

In the embodiment, the case where the control unit 4 includes the motor control unit 54 is described. However, the present invention is not limited to this. For example, in a case where the motor 18 rotates at a constant speed, the control unit 4 may not include the motor control unit 54.

It should be understood that the invention is not limited to the above-described embodiment, but may be modified into various forms on the basis of the spirit of the invention. Additionally, the modifications are included in the scope of the invention.

What is claimed is:

1. A cryocooler, comprising:

a compressor which compresses a low-pressure working gas to generate a high-pressure working gas;

a displacer which extends in an axial direction;

a cylinder in which the displacer is accommodated so as to be reciprocated in the axial direction;

a drive mechanism which drives the displacer; and a housing in which the drive mechanism is accommodated, wherein the drive mechanism includes:

an eccentric rotor, a yoke plate which is reciprocated by rotation of the eccentric rotor, a second shaft portion which extends from the yoke plate in the axial direction and is connected to the displacer, and a first shaft portion which extends from the yoke plate to a side opposite to the second shaft portion, wherein a gas expansion chamber is formed between the cylinder and the displacer on one side in the axial direction, wherein a room temperature chamber is formed between the cylinder and the displacer on the other side in the axial direction, and wherein the housing includes:

a first chamber in which the eccentric rotor and the yoke plate are accommodated, a second chamber in which a distal end of the first shaft portion is accommodated, and a third chamber which is provided between the second chamber and the room temperature chamber, and wherein the cryocooler further comprises:

a first high-pressure pipe which connects the second chamber to a high pressure side of the compressor;

a first valve provided on the first high-pressure pipe;

a first low-pressure pipe which connects the second chamber to a low-pressure side of the compressor;

a second valve provided on the first low-pressure pipe;

a second high-pressure pipe which connects the third chamber to the high pressure side of the compressor;

a third valve provided on the second high-pressure pipe;

a second low-pressure pipe which connects the third chamber to the low-pressure side of the compressor; and a fourth valve provided on the second low-pressure pipe.

2. The cryocooler according to claim 1, wherein the second shaft portion includes a first portion and a second portion, the second portion is connected to a displacer side of the first portion, wherein a cross-sectional area of the first portion and a cross-sectional area of the second portion are orthogonal to the axial direction, the cross-sectional area of the second portion is smaller than the cross-sectional area of the first portion, and wherein a connection portion is in the third chamber, the connection portion is between the first portion and the second portion.

3. The cryocooler according to claim 1, wherein the second chamber is connected so as to be switchable to the high-pressure side of the compressor and the low-pressure side of the compressor, and wherein the third chamber is connected so as to be switchable to the high-pressure side and the low-pressure side of the compressor.

4. The cryocooler according to claim 1, wherein one of the second chamber and the third chamber is adjusted so as to have a pressure between a pressure on the high-pressure side of the compressor and pressure on the low-pressure side of the compressor, and the other of the second chamber and the third chamber is connected so as to be switchable to the high-pressure side and the low-pressure side of the compressor.

5. The cryocooler according to claim 1, further comprising:

a seal between the first chamber and the third chamber, the seal is configured to air-tightly separate the third chamber from the first chamber.

6. The cryocooler according to claim 1, wherein the cryocooler further includes a control unit which acquires information relating to a force in the axial direction applied to the drive mechanism, and adjusts a pressure in the second chamber to alleviate the force.

7. The cryocooler according to claim 6, wherein the control unit includes an acquisition unit which acquires a strain amount of the second shaft portion in the axial direction from a strain sensor attached to the second shaft portion, and a force calculation unit which calculates a force in the axial direction applied to the drive mechanism from the strain amount.

8. The cryocooler according to claim 7, wherein the strain sensor is attached to the second shaft portion which is positioned in the first chamber.

9. The cryocooler according to claim 7, wherein the second shaft portion includes a narrowed portion, and the strain sensor is attached to the narrowed portion.

10. The cryocooler according to claim 1, wherein the third chamber is provided between the first chamber and the room temperature chamber.

11. The cryocooler according to claim 10, wherein the first shaft portion includes a first portion and a second portion, the second portion is connected to a displacer side of the first portion, wherein a cross-sectional area of the first portion and a cross-sectional area of the second portion are orthogonal to the axial direction, the cross-sectional area of the second portion is smaller than the cross-sectional area of the first portion, and wherein a connection portion is in the first chamber, the connection portion is between the first portion and the second portion.

12. The cryocooler according to claim 10, wherein the second shaft portion includes a first portion and a second portion, the second portion is connected to a displacer side of the first portion, wherein a cross-sectional area of the first portion and a cross-sectional area of the second portion are orthogonal to the axial direction, the cross-sectional area of the second portion is smaller than the cross-sectional area of the first portion, and wherein a connection portion is in the third chamber, the connection portion is between the first portion and the second portion.

* * * * *